United States Patent [19]

Moji

[11] Patent Number: 4,880,393

[45] Date of Patent: Nov. 14, 1989

[54] CONNECTOR WITH LOCKING MECHANISM

[75] Inventor: Eirou Moji, Mitaka, Japan

[73] Assignee: Moji & Co., Ltd., Tokyo, Japan

[21] Appl. No.: 262,009

[22] Filed: Oct. 25, 1988

[30] Foreign Application Priority Data

Aug. 5, 1988 [JP] Japan ..... 63-195838

[51] Int. Cl.[4] ..... H01R 13/627

[52] U.S. Cl. ..... 439/352

[58] Field of Search ..... 439/180, 347, 348, 350, 439/351, 352, 353, 354, 355, 357, 358; 285/316, 315, 319

[56] References Cited

U.S. PATENT DOCUMENTS 3,639,890 2/1972 Stevens et al. ..... 439/352
4,265,503 5/1981 Baur ..... 439/352 X
4,548,455 10/1985 Ezure ..... 439/152

*Primary Examiner*—Neil Abrams
*Assistant Examiner*—Khiem Nguyen
*Attorney, Agent, or Firm*—Browdy & Neimark

[57] ABSTRACT

A connector with a locking mechanism which includes a plug body, a cylindrical member secured to an outer periphery of the plug body, a slidable cover provided for forward and rearward movement on an outer periphery of the cylindrical member, a locking member provided for forward and rearward movement between the slidable cover and the cylindrical member, and a spring provided between the locking member and the cylindrical member for forwardly biasing said locking member. The locking member is provided with an interlocking portion interlocked to the slidable cover such that it is moved rearwardly against the spring force of the spring with a rearward movement of the slidable cover. A socket is provided which has contacts electrically connected to the contacts of the plug body. The slidable cover and the locking member are provided with respective interlocking portions interlocked to each other with a rearward movement of the slidable cover, and the interlocking portions are arranged such that a fixed gap is formed between the two in a state in which the contact surface of the locking portion provided on the front end of the locking member engages with the inclined member provided on the side of the plug body.

1 Claim, 10 Drawing Sheets

FIG. 2
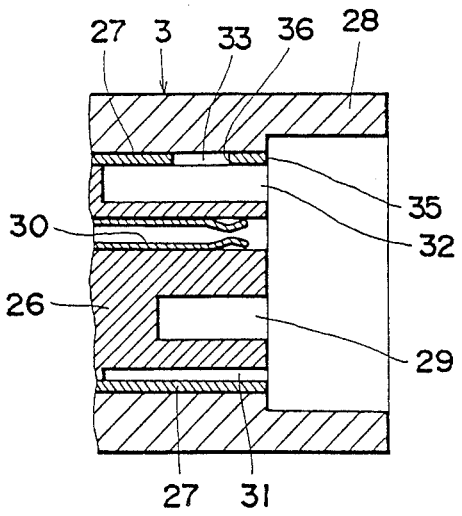
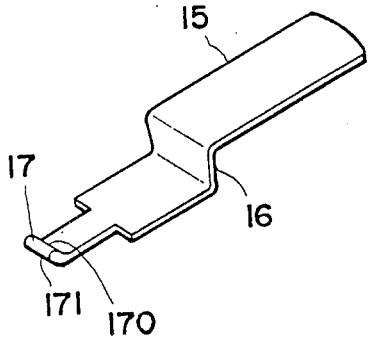
FIG. 3
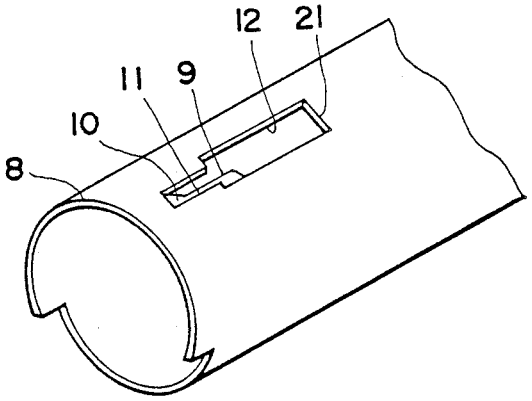
FIG. 4

CONNECTOR WITH LOCKING MECHANISM

BACKGROUND OF THE INVENTION

1. Field of the Invention

This invention relates to a connector with a locking mechanism for connecting a plug and a socket.

2. Description of the Prior Art

As the locking mechanism of such a connector, there is desired one which can lock a plug and a socket to each other when a cord connected to the plug is pulled and release the lock to permit ready detachment of the plug from the socket when the plug is pulled by holding the outer periphery thereof.

To meet this demand, a device has been proposed, which is disclosed in Japanese Utility Model Publication No. Sho 62-17995 (equivalent to U.S. Pat. No. 4,548,455).

This device is shown in FIGS. 17 and 18 of the present application. As shown, the plug side is provided with a locking piece B with a locking portion A and an insertion piece C, while the socket side D is provided with an annular groove E and a locking recess F, in which the locking portion A on the plug side is engaged. When the cord connected to the plug is pulled with the plug and socket connected together, the locking portion A is moved in unison with the insertion piece C to be locked. When the outer periphery of the plug other than the cord is pulled, only the insertion piece C is first removed from the annular groove E, and then the locking portion A is removed from the recess F with elastic downward displacement.

When this well-known means is implemented as an actual product, it often occurs that the plug is easily taken out from the socket D by slightly strongly pulling the cord connected to the plug. This occurs due to the fact that in the presently available plug product the locking piece B is formed by making use of a portion of a cylinder of the plug body made from a metal sheet with a thickness of 1 mm or less, the fact that the insertion piece C and locking portion A are respective synthetic resin molding and the fact that when the cord connected to the plug is pulled, a force is applied to the locking portion A and insertion piece C by the recess F in a direction of squeezing these parts so that the lock is released more readily than is theoretically conceivable.

SUMMARY OF THE INVENTION

This invention has been intended in order to solve the above problems inherent in the prior art means described above, and its object is to provide a connector with a locking mechanism, which permits releasing of the lock when the plug is pulled by holding the outer periphery thereof other than a cord and nevertheless ensures strong lock to be obtained when the cord connected to the plug is pulled.

To attain the above object of the present invention, there is provided a connector with a locking mechanism, which comprises a plug body made of an insulator and holding contacts, a cylindrical member secured to the outer periphery of the plug body, a locking member provided on the outer or inner periphery of the cylindrical member for movement in the axial direction, a spring provided between the locking member and the cylindrical member for forwardly biasing the locking member, the locking member having an end capable of being elastically displaced in the radial direction of the plug body, the end of the locking member being provided with a locking portion having a rear engagement surface and a front contact surface, an inclined member located at a position forwardly of and near the contact surface of the locking portion and fixed in position with respect to the plug body, and a socket having contacts electrically connected to the contacts of the plug body, the socket being provided with an annular groove, into which a front portion of the cylindrical member, the inclined member and the locking portion are capable of elastically advancing, the outer or inner periphery of the annular groove being provided with a locking recess, into which the engagement surface of the locking portion being advanced.

The above-mentioned and other objects and features of the invention will become apparent from the following detailed description taken in conjunction with the drawings which indicate embodiments of the invention.

BRIEF DESCRIPTION OF THE DRAWINGS

FIG. 2 is an axial sectional view showing a socket of the same embodiment;

FIG. 3 is a perspective view showing a locking member of the same embodiment;

FIG. 4 is a fragmentary perspective view showing a cylindrical member;

DESCRIPTION OF THE PREFERRED EMBODIMENTS

Figure 1:
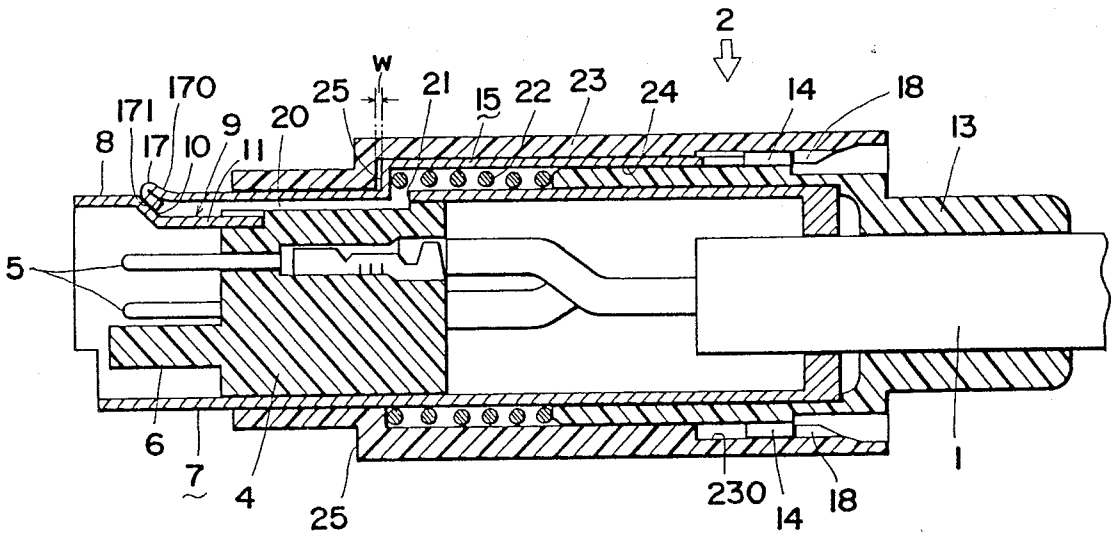
FIG. 1 is an axial sectional view showing a plug of one embodiment of the connector according to the present invention.

A first embodiment of the present invention will now be described with reference to FIGS. 1 to 12. FIG. 1 is an axial sectional view showing a plug 2 of the embodiment connected to a cord 1, and FIG. 2 is an axial sectional view showing a socket 3 of the embodiment, into which the plug 2 is to be inserted. Referring to FIGS. 1 to 4, reference numeral 4 designates a cylindrical plug body made of an insulating material. A plurality of contacts 5 are embedded in the plug body 4, the contacts being connected to ends of core wires of the cord 1. In this embodiment, the contacts 5 are male contacts, but in some cases female contacts may be provided. The plug body 4 has an integral positioning projection 6 extending from the front end face (i.e., left end face in FIG. 1).

A hollow cylindrical member 7 made of a metal is coaxially fittedly secured to the outer periphery of the plug body 4. The cylindrical member 7 extends forwardly and rearwardly (i.e., to the left and right in FIG. 1) of the plug body 4, and its front portion 8 extending forwardly (i.e., to the left in FIG. 1) of the plug body 4 is to be inserted in the socket 3. An upper portion of the front portion 8 of the cylindrical body 7 is formed with a cut-and-bent portion 9, which has an inclined portion 10 inclined into the cylindrical member 7 as one goes rearwardly and a horizontal portion 11 extending rearwardly horizontally from the rear end of the inclined portion 10. The inclined portion 10 is very important according to the invention. The rear end of the horizontal portion 11 engages a front stepped portion of the plug body 4. The cylindrical member 7 has an opening 12 corresponding to the cut-and-bent portion 9 and facing to the outer periphery of the plug body 4 (FIG. 4).

A holding member 13 made of a synthetic resin or a metal is secured to the outer periphery of a rear portion of the cylindrical member 7. The holding member 13 surrounds a portion of the cord 1 with the core wires thereof connected to the contacts 5 embedded in the plug body 4. A portion of the outer periphery of the holding member 13 corresponding to the rear end of the cylindrical member 7 is provided with a plurality of radially spaced-apart outward projections 14.

Reference numeral 15 designates a locking member, which is movable forwardly and rearwardly with respect to the outer periphery of the cylindrical member 7. The locking member 15 is formed from a longitudinally elongate metal (or synthetic resin) strip having a spring character. It has a shape like a crankshaft with a perpendicular bent portion 16 provided at an intermediate position in its longitudinal direction (FIG. 3). The perpendicular bent portion 16 cooperates with a slidable cover 23 as will be described later. The locking member 15 has a locking portion 17 provided at its front end. The locking portion 17 has a parallelogrammic side sectional profile having a front lower contact surface 171 to be in contact with the inclined portion 10 noted above and a rear upper engagement surface 170 for engagement with the socket 3. A portion of the locking member 15 on the front side of the perpendicular bent portion 16 is imparted with elasticity so that the locking portion 17 at the front end is movable in the radial direction of the cylindrical member 7. The front portion noted above of the locking member 15 extends in a recess 20 defined by the opening 12 of the cylindrical member 7 and cut-and-bent portion 9. When the locking member 15 is moved forwardly with respect to the cylindrical member 7, the contact surface 171 of the locking portion 17 is brought into contact with the inclined portion 10 of the cut-and-bent portion 9 of the cylindrical member 7. When the locking member 15 is moved rearwardly, the rear surface of the perpendicular bent portion 16 is brought into contact with a rear edge 21 of the opening 12. The portion of the locking member 15 extending rearwardly from the perpendicular bent portion 16 is received in a groove formed in the outer periphery of the holding member 13. A spring 22 is provided between the front end of the holding member 13 and the rear surface of the perpendicular bent portion 16 and forwardly biases the locking member 15 to have the contact surface 171 and inclined portion 10 in contact with each other.

The slidable cover 23 is a cylindrical member made of a synthetic resin, and it is forwardly and backwardly slidably fitted on the outer periphery of the plug, which consists of the plug body 4, cylindrical member 7 fitted on the outer periphery of the plug body 4 and holding member 13 surrounding the rear half of the cylindrical member 7. The inner periphery of cover 23 is formed adjacent to the rear end with an increased-diameter portion 230 corresponding to the outer-diameter dimension of the array of projections 14 provided on the holding member 13, and is also formed at the rear end of the increased-diameter portion 230 with inward projections 18 for engagement with the rear surfaces of the outward projections 14 noted above. The inward projections 18 each have an inclined rear surface. As the assembly consisting of the plug body 4, cylindrical member 7 and holding member 13 is inserted into the slidable cover 23 from the open rear end thereof, the outward projections 14 on the outer periphery of the holding member 13 are moved along the inclined surfaces of the inward projections 18 and are advanced into the slidable cover 23 by forcibly spreading the slidable cover 23 of the synthetic resin. When the outward projections 14 clear the inward projections 18, they engage with the inward projections 18, as shown in FIG. 1. In this state, the slidable cover 23 is prevented from being forwardly detached from the plug assembly. The slidable cover 23 has a shoulder or interlocking portion 25 provided at a position near its front end. When the slidable cover 23 is moved rearwardly from the state shown in FIG. 1, the shoulder portion 25 strikes the front surface of the perpendicular bent portion 16, which forms an interlocking portion of the locking member 15 and moves the locking member 15 rearwardly. The shoulder portion 25 and perpendicular bent portion 16 are arranged such that a fixed gap w is formed between the front surface of the perpendicular bent portion 16 and the rear surface of the shoulder portion 25 in a state, in which the contact surface 171 of the locking portion 17 of the locking member 15 at the front end thereof and inclined portion 10 of the cut-and-bent portion 9 of the cylindrical member 7 are in contact with each other and the inward projections 18 of the slidable cover 23 at the rear end thereof and the rear surfaces of the outward projections 14 of the holding member 13 are in engagement with one another.

Accordingly, the slidable cover 23 is moved forwardly by the spring 22 through the locking member 15 until the inward projections 18 of the increased-diameter portion 230 on the rear end thereof strike the outward projections 18 formed on the outer periphery of the holding member 13 to prevent the forward movement of the slidable cover 23. When the slidable cover 23 slides rearwardly, it contacts the locking member 15 with the engagement between the perpendicular bent portion 16 and the shoulder portion 25 to move rearwardly together with the locking member 15 with respect to the plug body 4, cylindrical member 7 and holding member 13. After the rear surface of the perpendicular bent portion 16 of the locking member 15 has been in contact with the rear edge 21 of the opening 12 of the cylindrical member 7, the slidable cover 23 pulls the entire plug 2 rearwardly. Further, when the cord 1 is pulled rearwardly, a force for pulling the slidable cover 23 rearwardly is applied to the locking member 15 with the engagement between the perpendicular bent portion 16 and the shoulder portion 25 after the gap w between the perpendicular bent portion 16 and the shoulder portion 25 disappears with the rearward movement of the slidable cover 23.

The socket 3 noted above includes a central socket body 26 made of an insulating material, a cylindrical member 27 made of a metal and secured to the outer periphery of the socket body 26 and a socket cover 28 covering the cylindrical member 27.

The socket body 26 is provided with a positioning recess 29, in which the positioning projection 6 of the plug body 4 of the plug 2 is engaged, and also with contacts 30 which engage with the contacts 5 of the plug 2. In the illustrated embodiment, the contacts 30 are female contacts because the contacts 5 of the plug 2 are male contacts. However, male contacts are provided in case where the contacts of the plug 2 are female contacts. Between the cylindrical member 27 and the socket body 26, there is formed an annular groove 31, into which the front portion 8 of the cylindrical member 7 of the plug 2 is inserted. The annular groove 31 has an increased-depth portion 32, into which the cut-and-bent portion 9 of the plug 2 is inserted. The cylindrical member 27 is formed with a locking recess 33, in which the locking surface 170 of the locking portion 17 of the plug 2 is engaged.

This embodiment, having the construction as described above, has the following function.

When connecting the plug 2 and socket 3 to each other, the front portion 8 of the cylindrical member 7 is inserted into the annular groove 31 with the positioning projection 6 and positioning recess 29 aligned to each other by holding slidable cover 23 of the plug 2.

Figure 5:
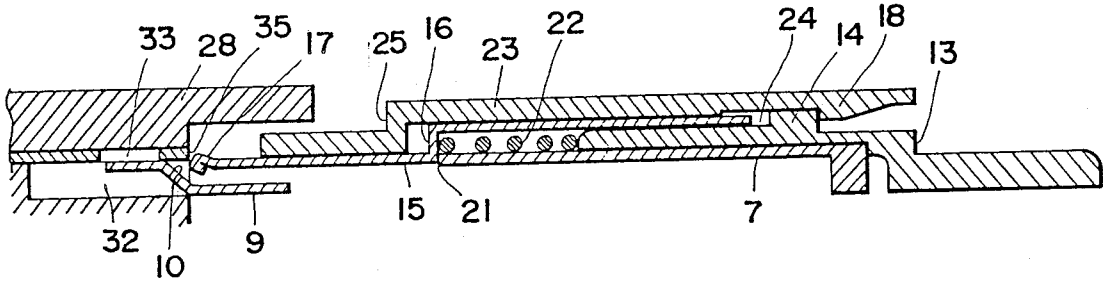
FIG. 5 is an explanatory view illustrating the embodiment with a locking portion and a rear end of the cylindrical member in contact with each other.
Figure 6:
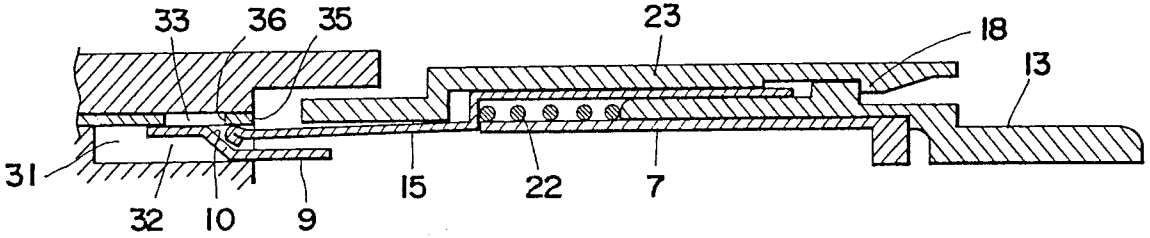
FIG. 6 is an explanatory view showing the same embodiment with the locking portion elastically downwardly displaced.

As a consequence, the inward projections 18 formed on the inner periphery of the slidable cover 23 adjacent to the rear end thereof strike the rear surfaces of the outward projections 14 formed on the outer periphery of the holding member 13 and push the holding member 13 forwardly, thus pushing the entire plug 2. Thus, the cut-and-bent portion 9 of the cylindrical member 7 on the front end of the plug 2 is advanced into the increased-depth portion 32 of the annular groove 31 of the socket 3, and the locking portion 17 of the locking member 15 at the front end thereof is brought into contact with the rear end 35 of the cylindrical member 27 of the socket 3, as shown in FIG. 5. The slidable cover 23 is further pushed forwardly from this state. As a result, the locking portion 17 of the locking member 15 in contact with the rear end 35 of the cylindrical member 27 of the socket 3 is advanced into the annular groove 31 in being elastically downwardly displaced (FIG. 6) and then strikes the inclined portion 10 by receiving the pushing action from the spring 22 to be guided along the inclined portion 10 into the locking recess 33 of the cylindrical member 27 as shown in FIG. 7, thus completing the connection of the plug 2 and socket 3 to each other.

Figure 7:
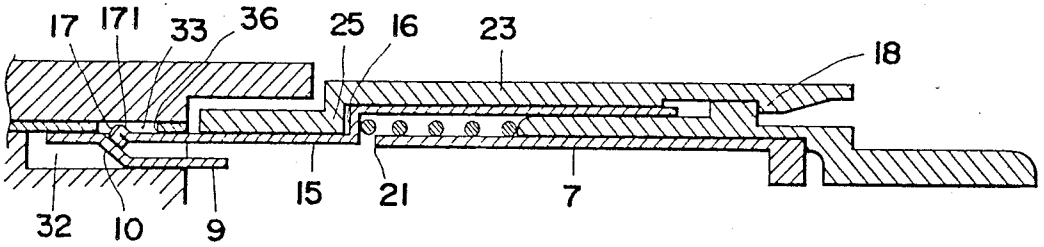
FIG. 7 is an explanatory view showing the plug and socket connected to each other.
Figure 8:
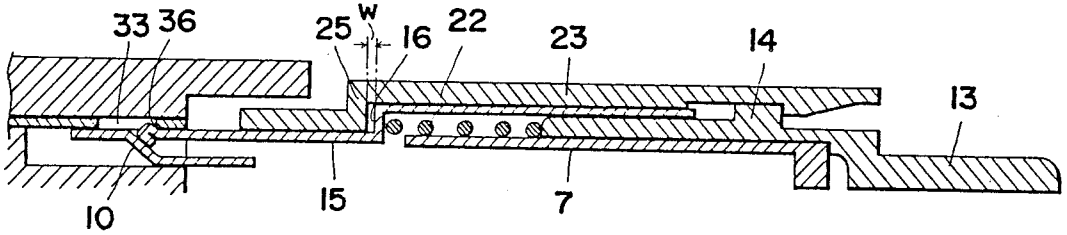
FIG. 8 is an explanatory view showing a state of lock.
Figure 9:
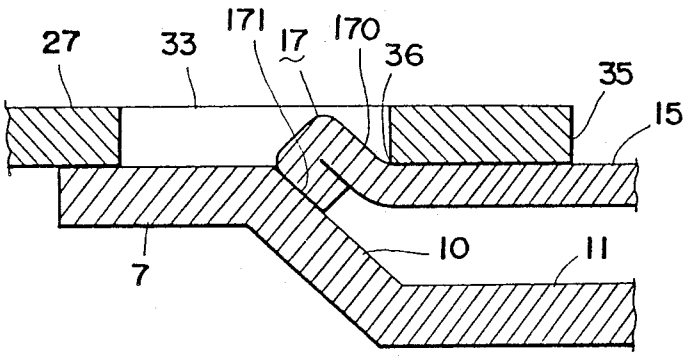
FIG. 9 is an enlarged-scale explanatory view showing the state of lock.

Then, the cord 1 connected to the plug 2 is pulled rearwardly in the state of the connector shown in FIG. 7. As a result, the plug body 4 integrally connected to the cord 1 is retreated rearwardly together with the cylindrical member 7 and holding member 13, and also the slidable cover 23 is retreated with the engagement between the rear surfaces of the outward projections and the front surfaces of the inward projections. Thus, the plug 2 is retreated in the state shown in FIG. 7, and the engagement surface 170 of the locking portion 17 of the locking member 15 provided on the side of the plug 2 and rear end 35 of the locking recess 33 provided on the side of the socket 3 are brought into contact with each other, as shown in FIG. 8. The inclined portion 10 of the cut-and-bent portion 9 of the cylindrical member 7 is rearwardly brought into contact with the contact surface 171 of the locking portion 17 of the locking member 15. In this state, the inclined portion 10 of the cylindrical member 7 is going to be further moved rearwardly. Thus, a force for pushing up the locking portion 17 toward the locking recess 33 acts on the locking portion 17 due to the surface pressure between the inclined portion 10 and the contact surface 171. The locking portion 17 thus wedges into between the inclined portion 10 and the rear end 35 of the locking recess 33, as shown in FIG. 9, and the inclined portion 10 is connected to the locking recess 33 via the locking portion 17 serving as a wedge at this time, thus preventing the detachment of the plug 2 from the socket 3. The lock of the plug 2 and socket 3 by a sort of wedge effect thus obtained is strong. In an actual product, the engagement surface 170 which is less than 1 mm in size strongly engages with the locking recess 33, thus reliably preventing the detachment of the plug 2 from the socket 3.

Where the gap w is formed between the shoulder portion 25 and the perpendicular bent portion 16 as in this embodiment, even when the slidable cover 23 is pulled rearwardly in following the plug body 4 as the locking portion 17 of the locking member 15 is urged with the pulling of the cord 1 from the state shown in FIG. 8, no force is applied to the locking member 15 in the pulling direction until the gap w disappears with the movement of the slidable cover 23. Thus the locking portion 17 of the locking member 15 is urged in a stationary state against the locking recess 33 by the inclined portion 10. This has an effect of reinforcing the wedge effect as noted above.

Figure 10:
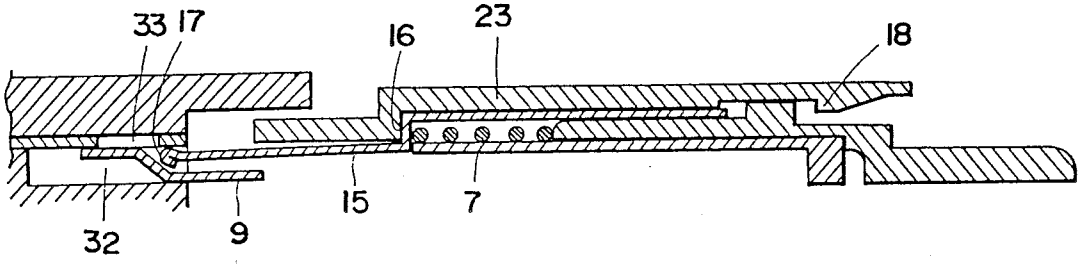
FIGS. 10 and 12 are explanatory views showing a procedure of withdrawing the plug.
Figure 11:
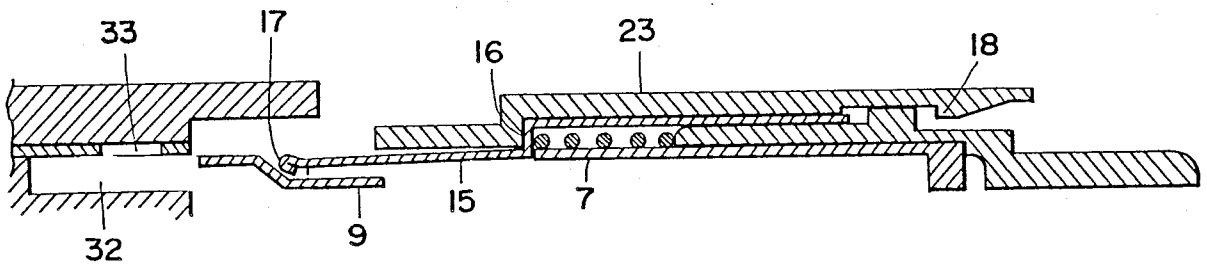
Figure 12:
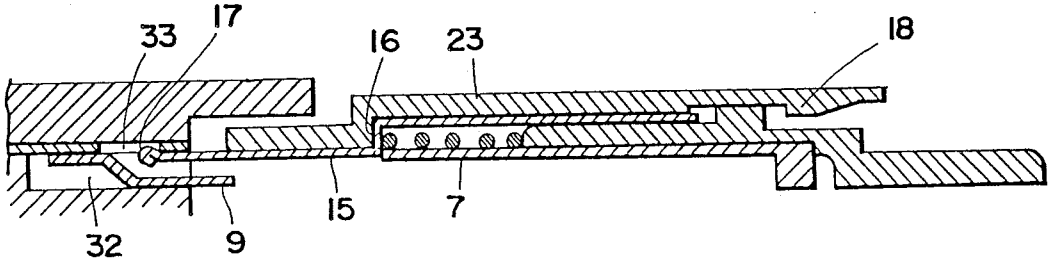

When releasing the connection, the slidable cover 23 of the plug 2 is pulled toward the operator by holding it. As a result, only the locking member 15 is withdrawn in the state shown in FIG. 8, in which the inclined portion 10 is not urged by the locking portion 17. The lock is thus released as shown in FIG. 10. The plug 2 now can be withdrawn from the socket 3 by taking out the slidable cover 23 as shown in FIG. 11.

If the locking portion 17 is wedging tightly in the locking recess 33 so that the plug 2 is difficult to withdraw, the slidable cover 23 is pushed once to recover the state as shown in FIG. 7, and in this state the slidable cover 23 is pulled out. As a result, the locking portion 17 can be easily detached through the state shown in FIG. 12 with elastic displacement of the locking member 15.

Figure 13:
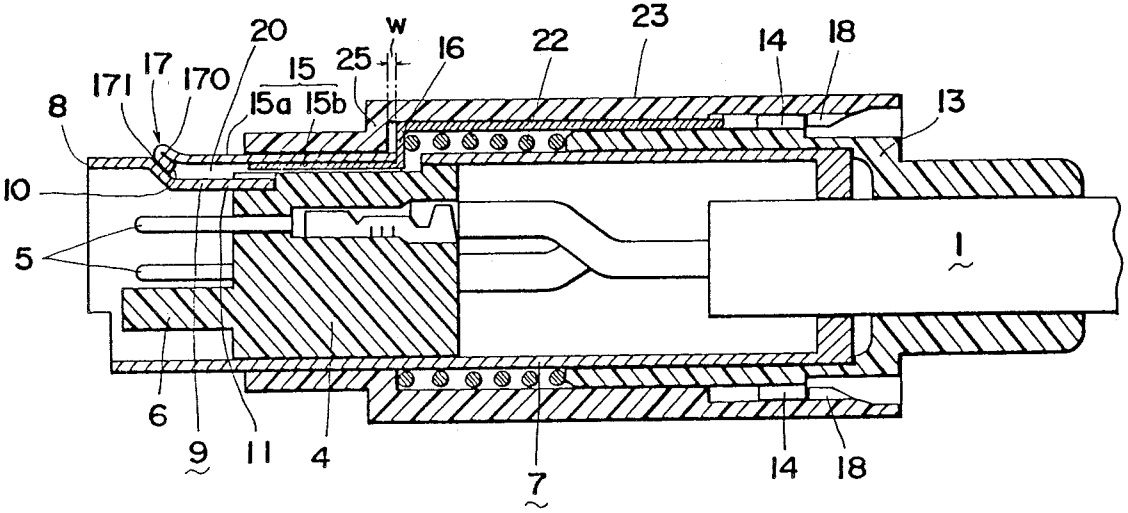
FIG. 13 is an axial sectional view showing a modification of the embodiment.

FIG. 13 shows a modification of the above embodiment. In this modification, the locking member 15 is constituted by two separate members, namely a front end member **15*a* with the locking portion 17 provided at the free end and a rear end portion 15*b* provided which is forwardly biased by the spring 22, the front end portion 15*a* being overlapped over and linked to a front end portion of the rear end member 15*b***. The remaining construction is the same as that of the preceding embodiment, and like parts are designated by like reference numerals with omission of their further detailed description.

In this modification, the formation and assembly of the locking member 15 can be facilitated. The construction of the plug 2 after the assembling of the locking member 15 is the same as in the previous embodiment, and provides the same function.

Figure 14:
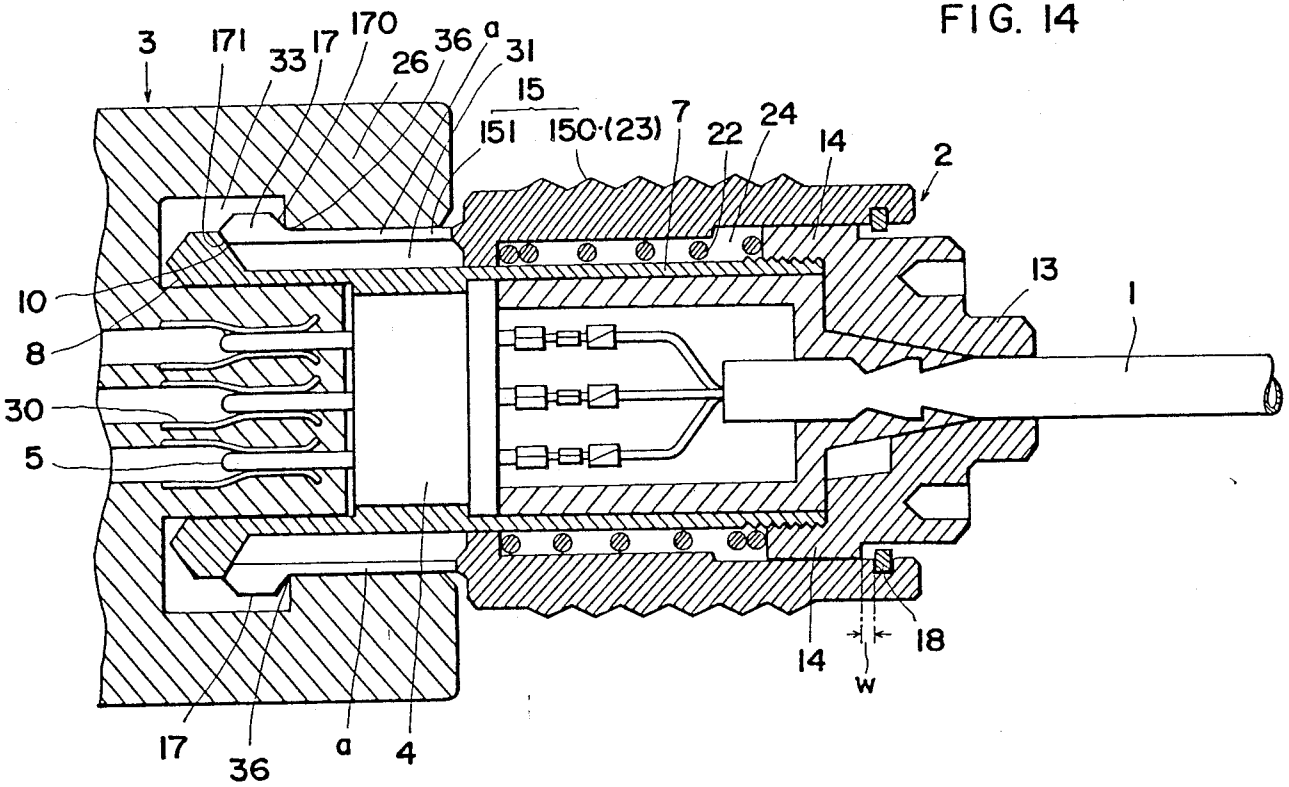
FIG. 14 is an axial sectional view showing a different embodiment of the present invention.

FIG. 14 shows a different embodiment of the invention. In this embodiment, the slidable cover 23 and locking member 15, which are formed as separate members in the previous embodiment, are integral with each other. Therefore, only this difference will be described in detail, and like parts constituting like construction are designated by like reference numerals with omission of further detailed description of these parts.

In this embodiment, the locking member 15 is a cylindrical member made of a synthetic resin or a metal. Its rear half portion 150 is forwardly and rearwardly slidably fitted substantially as a slidable cover on the outer periphery of the rear half of the cylindrical member 7 and the outer periphery of the holding member 13, and its front half portion 151 located substantially as the locking member 15 on a portion of the outer periphery of the cylindrical member 7 surrounding the plug body 4 constitutes a forwardly and rearwardly movable support member.

Figure 15:
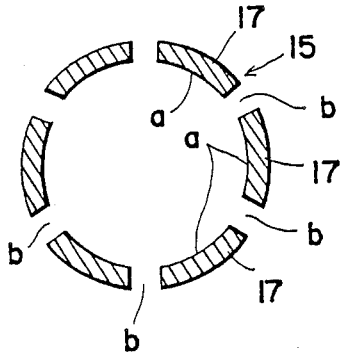
FIG. 15 is a radial sectional view showing a locking member of the same embodiment.
Figure 17:
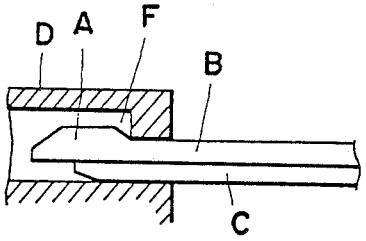
FIGS. 17 and 18 are pictorial fragmentary sectional views showing a well-known structure, respectively.
Figure 18:
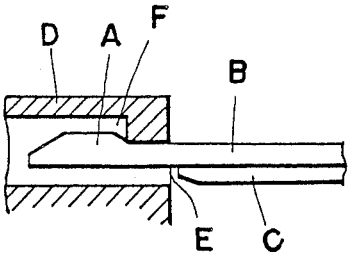

The front half portion 151 is formed with a plurality of circumferentially suitably spaced-apart axial notches b to form a plurality of divisions a arranged in an annular array as shown in FIG. 15. These divisions a, as shown in FIG. 14, have a reduced thickness and are spring-like so that they can be elastically flexed in the radial direction. Each of the divisions a has a locking portion 17 provided at the free end. Thus, each division a can function as the locking member.

The locking portion 17 provided at the free end of each division a is similar to the locking portion 17 in the preceding embodiment insofar as it has a front side contact surface 171 and a rear side engagement surface 170. However, its side sectional profile is not parallelogrammic, but it has a shape not projecting on the inner surface side but projecting only on the outer surface side.

In the cylindrical member 7, its front portion 8 has an outer flange portion having an inclined rear surface, the diameter of which is reduced progressively as one goes rearwardly. The portions of this annularly continuous inclined surface corresponding to the contact surfaces 171 of the locking portions 17 at the free end of the individual divisions a constitute the inclined portion 10. Thus, in this embodiment, unlike the previous embodiment, the cut-and-bent portion 9 is not provided, and only the inclined portion 10 is provided.

The locking recess 33 formed in the socket 3 for receiving each locking portion 17 is formed annularly in the wall surface of the annular groove 31. It is important that each locking portion 17 is arranged such that it can be clamped between the locking recess 33 provided on the side of the socket 3 and the inclined portion 10 provided on the side of the plug 2. It is alternatively possible to provide each locking portion 17 of the locking member 15 on the inner periphery of the cylindrical member 7 and provide the inclined portion 10 and locking recess 33 on the inner periphery of the cylindrical member 7.

Further, since in this embodiment the locking member 15 and slidable cover 23 are integral with each other, the shoulder portion 25 and perpendicular bent portion 16 for connecting these two portions are not provided. For this reason, the gap w for ensuring reliable wedging effect is provided between an engagement member 18 provided as a stopper ring on the inner periphery of the locking member 15 adjacent to the rear end of the cylindrical rear half portion 150 of the locking member 15 and an engagement member 14 provided on the outer periphery of the holding member 13.

This embodiment functions similarly to the previous embodiment. In addition, the locking member 15 also serves as the slidable cover 23, thus facilitating the manufacture and assembly.

Figure 16:
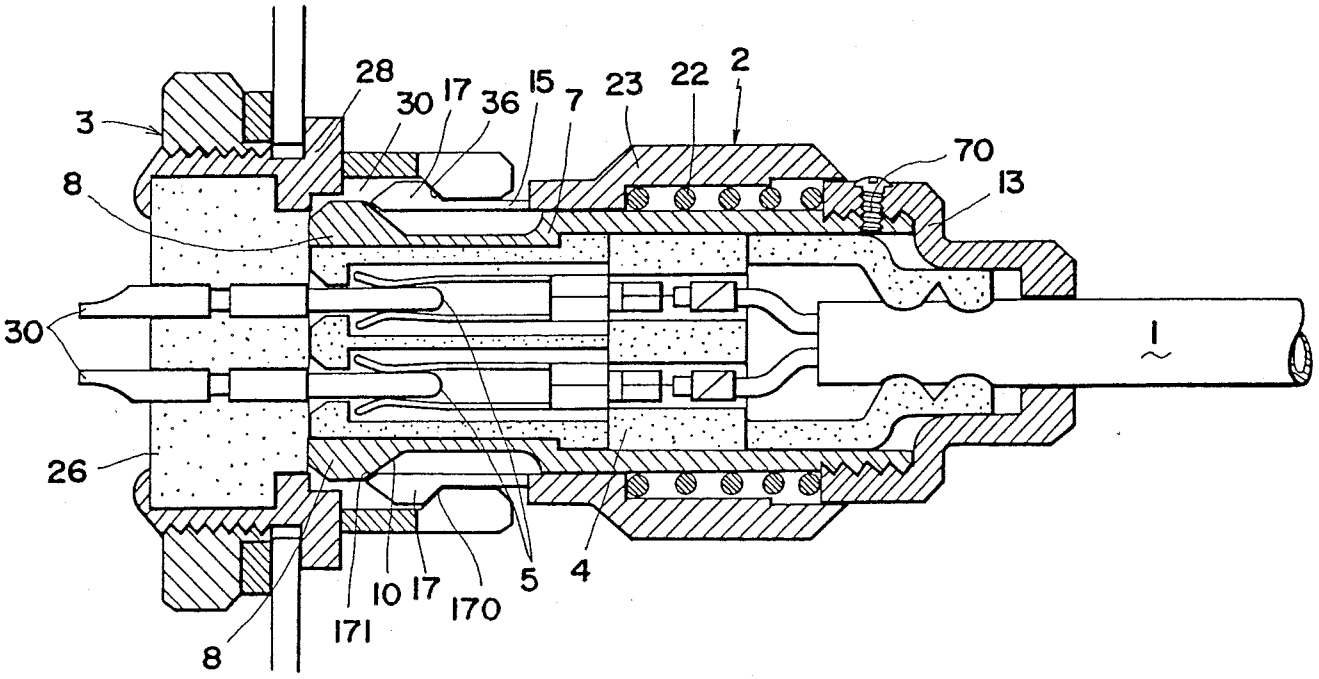
FIG. 16 is an axial sectional view showing a further embodiment of the present invention.

FIG. 16 shows a further embodiment of the invention.

In this embodiment, no pulling force is applied to the locking member 15 when the cord 1 is pulled, thus making the gap w noted above unnecessary. The holding member 13 which is formed as an independent member is assembled by a screw 70 to the rear end of the cylindrical member 7. This assembly is done after the locking member 15 integral with the slidable cover 23 was fitted on the outer periphery of the cylindrical member 7. The holding member 13 thus prevents rearward detachment of the locking member 15 and slidable cover 23, and forward detachment is prevented with the engagement of the locking portions 17 with the inclined portion 10. Further, the metal cylindrical member 27 of the socket 3 also serves as a metal socket cover 28.

The remaining construction is the same as in the preceding embodiments and like parts are designated by like reference numerals with omission of their further detailed description.

This embodiment functions similarly to the preceding embodiments. In addition, when the cord 1 is pulled rearwardly with the plug 2 connected to the socket 3 as shown in FIG. 16, the locking member 15 does not experience any rearwardly pulling force. Thus the locking portions 17 are pushed more reliably by the inclined portion.

As has been described in the foregoing, the connector with a locking mechanism according to the invention comprises the plug body 4 made of an insulator and holding the contacts 5, cylindrical member 7 secured to the outer periphery of the plug body 4, locking member 15 provided on the outer or inner periphery of the cylindrical member 7 for movement in the axial direction, spring 22 provided between the locking member 15 and the cylindrical member 7 for forwardly biasing the locking member 15, the locking member 15 having an end capable of being elastically displaced in the radial direction of the plug body 4, the end of the locking member 15 being provided with the locking portion 17 having the rear engagement surface 170 and front contact surface 171, inclined portion 10 located at a position forwardly of and near the contact surface of the locking portion 17 and fixed in position with respect to the plug body 4, and socket 3 having the contacts 30 electrically connected to the contacts 5 of the plug body 4, the socket 3 being provided with the annular groove 31, into which the front portion 8 of the cylindrical member 7, inclined portion 10 and locking portion 17 are capable of electrically advancing, the outer or inner periphery of the annular groove 31 being provided with the locking recess 33, into which the engagement surface 170 of the locking portion 17 is advanced. Thus, it is possible to obtain a connector with a locking mechanism, which permits releasing of a lock by pulling a portion of the plug outer periphery other than the cord and ensures a strong lock when the cord connected to the plug is pulled.

What is claimed is:

1. A connector with a locking mechanism comprising:

a plug body made of an insulator and holding contacts;

a cylindrical member secured to an outer periphery of said plug body;

a slidable cover provided for forward and rearward movement on an outer periphery of said cylindrical member;

a locking member provided for forward and rearward movement between said slidable cover and said cylindrical member;

a spring provided between said locking member and said cylindrical member for forwardly biasing said locking member;

said locking member being provided with an interlocking portion interlocked to said slidable cover such that it is moved rearwardly against the spring force of said spring with a rearward movement of said slidable cover, said locking member having an end capable of being elastically displaced in the radial direction of said plug body, said end of said locking member being provided with a locking portion having a rear engagement surface and a front contact surface;

an inclined member located at a position forwardly of and near said contact surface of said locking portion and fixed in a position with respect to said plug body; and a socket having a contacts electrically connected to said contacts of said plug body, said socket being provided with an annular groove, into which a front portion of said cylindrical member, said inclined member and said locking portion are capable of advancing while being elastically deformed, the outer or inner periphery of said annular groove being provided with a locking recess, into which said engagement surface of said locking portion is advanced;

said plug body being provided on an outer periphery thereof with a first engagement portion;

said slidable cover being provided adjacent to its rear end with a second engagement portion for engaging with the first engagement portion of said plug body to prevent forward detachment of said slidable cover;

said slidable cover and said locking member being provided with respective interlocking portions interlocked to each other with a rearward movement of said slidable cover, said wherein said interlocking portions are arranged such that a fixed gap is formed between to two in a state in which the contact surface of said locking portion provided on the front end of said locking member engages with said inclined member provided on the side of said plug body.

* * * * *